US005775558A

United States Patent [19]

Montalbano

[11] Patent Number: 5,775,558

[45] Date of Patent: Jul. 7, 1998

[54] HARNESS-TYPE SECURING SYSTEM FOR PERSONAL EQUIPMENT

[76] Inventor: Isabella Montalbano, 1321 Dawsberry Way, New Port Richey, Fla. 34655

[21] Appl. No.: 736,345

[22] Filed: Oct. 23, 1996

[51] Int. Cl.[6] ..... A45F 5/00

[52] U.S. Cl. ..... 224/627; 224/610; 224/605; 224/911; 224/675; 224/930; 224/647

[58] Field of Search ..... 224/911, 600, 224/606, 623, 624, 625, 626, 603, 604, 605, 627, 637, 638, 646, 647, 904, 610, 930, 675

[56] References Cited

U.S. PATENT DOCUMENTS

| | | | |
|---|---|---|---|
| D. 214,560 | 7/1969 | Kassel | 224/911 |
| 1,884,328 | 10/1932 | Sperling | 224/623 |
| 2,620,479 | 12/1952 | Buck | 224/638 |
| 3,739,961 | 6/1973 | Soukeras | 224/627 |
| 4,346,827 | 8/1982 | Bianchi et al. | 224/911 |
| 4,750,652 | 6/1988 | Grant | 224/627 |
| 4,828,154 | 5/1989 | Clifton, Jr. | 224/904 |
| 5,129,562 | 7/1992 | Bianchi | 224/911 |
| 5,246,153 | 9/1993 | Beletsky | 224/911 |
| 5,263,618 | 11/1993 | Talavera | 224/624 |
| 5,361,953 | 11/1994 | Nichols | 224/911 |

*Primary Examiner*—Henry J. Recla
*Assistant Examiner*—Gregory M. Vidovich

[57] ABSTRACT

A harness-type securing system adapted for use in association with personal equipment comprising a harness assembly including at least two front straps, at least two rear straps and a central strap coupler, each strap having an inboard end and an outboard end, each strap including adjustment devices, the inboard ends of each straps being coupled to the center strap coupler, in an operative orientation a user positioning harness upon his torso; and at least two pouches, each pouch having at least one compartment and including securement means to firmly retain personal objects therein, each pouch being couplable to the harness to enable users to carry personal equipment in a suspended orientation from the harness.

13 Claims, 4 Drawing Sheets

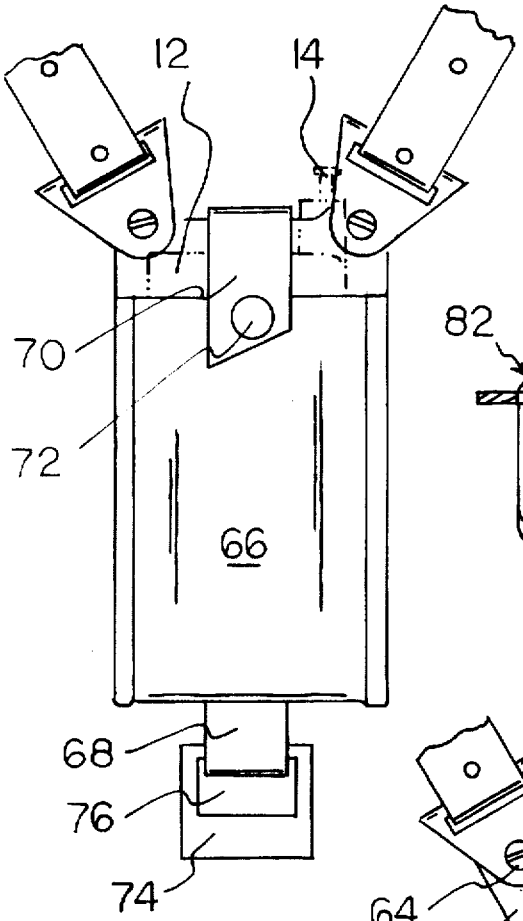
FIG 3
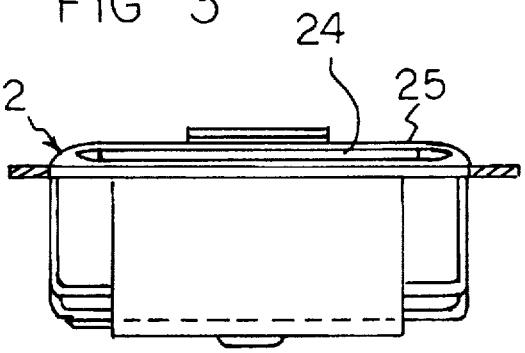
FIG 4A
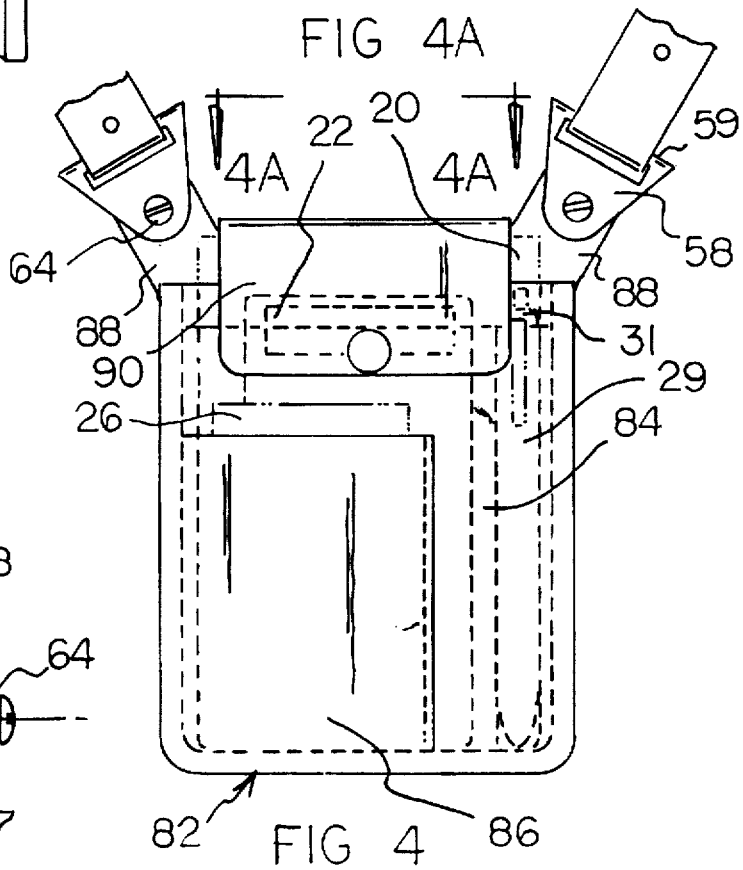
FIG 4
FIG 3A
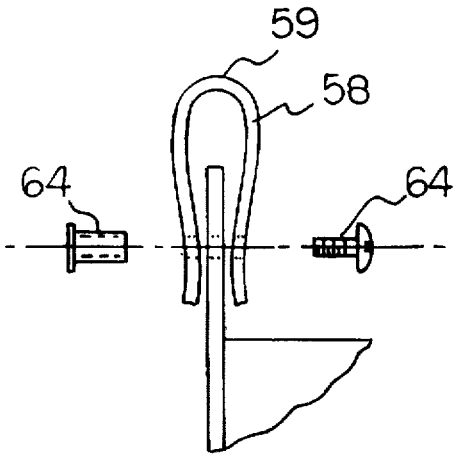

HARNESS-TYPE SECURING SYSTEM FOR PERSONAL EQUIPMENT

BACKGROUND OF THE INVENTION

1. Field of the Invention

The present invention relates to a harness-type securing system for personal equipment and more particularly pertains to enabling users to carry and quickly access various items of personal equipment.

2. Description of the Prior Art

The use of equipment holders is known in the prior art. More specifically, equipment holders heretofore devised and utilized for the purpose of carrying equipment are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,358,159 to Lundie, Jr. discloses a holster type-holder for electronic communications equipment.

While these devices fulfill their respective, particular objective and requirements, the aforementioned patents do not describe a harness-type securing system for personal equipment for enabling users to carry and quickly access various items of personal equipment.

In this respect, the harness-type securing system for personal equipment according to the present invention substantially departs from the conventional concepts and designs of the prior art, and in doing so provides an apparatus primarily developed for the purpose of enabling users to carry and quickly access various items of personal equipment.

Therefore, it can be appreciated that there exists a continuing need for new and improved harness-type securing system for personal equipment which can be used for enabling users to carry and quickly access various items of personal equipment. In this regard, the present invention substantially fulfills this need.

SUMMARY OF THE INVENTION

In the view of the foregoing disadvantages inherent in the known types of equipment holders now present in the prior art, the present invention provides an improved harness-type securing system for personal equipment. As such, the general purpose of the present invention, which will be described subsequently in greater detail, is to provide a new and improved harness-type securing system for personal equipment and method which has all the advantages of the prior art and none of the disadvantages.

To attain this, the present invention essentially comprises a new and improved harness-type securing system for personal equipment comprising, in combination: a cellular telephone; a pager with a rear clip; an electronic organizer; a calculator; a note pad, business cards and a pen; a camera and two associated film cylinders; a personal stereo including a rear clip and headphones; a handgun having a butt, a barrel, a trigger guard and associated magazine clip; a harness assembly comprising two front straps, two rear straps, a central strap coupler and a plurality of pouch connectors, each strap having an inboard end and an outboard end, each strap including a plurality of spaced circular holes positioned therethrough, the center strap coupler being formed in a planar configuration and including a plurality of apertures, the inboard ends of each of the straps being coupled to the center strap coupler by rivets, in an operative orientation a user positioning harness upon his torso with the front straps extending over his shoulders and across his chest, the rear straps extending downwardly and outwardly along his back; a cellular telephone pouch, an electronic organizer pouch, a camera pouch, a handgun pouch and a personal stereo pouch, each pouch being formed in a generally rectangular configuration with a front face, a rear face, an interior compartment and two side walls, each front face having an upper extent including snap coupling means, each rear face including two upper horns and securing means couplable to the snap coupling means of the front face, each pouch including a belt securing strap having inboard and outboard ends including pile type fasteners, the inboard end being coupled to the rear face of the pouch; the cellular telephone pouch including a lower loop, a pager holder being coupled through the lower loop and including an aperture, the two side walls of the cellular telephone pouch being formed of elastic materials and the securing means comprising a securing strip, in an operative orientation a user positioning the cellular telephone within the pouch and securing it in place; a user coupling the pager to the pager holder by fastening the rear clip of the pager through the aperture of the pager holder; the front face of the electronic organizer pouch including a large front pocket, a small front pocket and a pen slot, the rear face including a rear pocket, the securing means comprising a securing flap, in an operative orientation a user positioning the electronic organizer within the pouch and securing it in place, the note pad being positioned within the rear pocket, the calculator being positioned within the large front pocket, the business cards being positioned within the small front pocket and the pen being positioned within the pen slot; the side walls of the camera pouch being sufficiently wide to permit placement of the camera therein, the securing means comprising a securing flap, in an operative orientation a user positioning the camera and the film cylinders within the pouch; the personal stereo pouch including an attachment clip affixed to its front face, the securing means comprising a securing flap, in a first operative orientation a user positioning the personal stereo and headphones within the pouch, in a second operative orientation a user securing the rear clip of the personal stereo to the attachment clip on the front face of the pouch; the interior compartment of the handgun pouch being divided into separate gun and magazine compartments by internal stitching, the internal stitching being shaped to follow the contour of the butt, trigger guard and barrel of the handgun, the securing means comprising a securing flap, in an operative orientation a user positioning the handgun within the handgun compartment with the barrel of the gun facing downward, the magazine clip being positioned within the magazine compartment; and a pouch connector being positioned around each of the four straps adjacent its outboard end, the outboard end of each strap being folded upon itself and coupled in place by releasably couplable rivets, two pouches being couplable to the harness at one time, a pouch being coupled to the harness by securing the horns of the pouch to the pouch connector of a front strap and the pouch connector of a rear strap with releasably couplable rivets, the straps being adjustable so that about one-third of the pouch is suspended below the user's belt adjacent to the user's hip, the user then securing the belt securing strip around his belt to minimize movement of the apparatus.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved harness-type securing system for personal equipment which has all the advantages of the prior art equipment holders and none of the disadvantages.

It is another object of the present invention to provide a new and improved harness-type securing system for personal equipment which may be easily and efficiently manufactured and marketed.

It is a further object of the present invention to provide a new and improved harness-type securing system for personal equipment which is of durable and reliable construction.

An even further object of the present invention is to provide a new and improved harness-type securing system for personal equipment which is susceptible of a low cost of manufacture with regard to both materials and labor, and which accordingly is then susceptible of low prices of sale to the consuming public, thereby making such a harness-type securing system for personal equipment economically available to the buying public.

Still yet another object of the present invention is to provide a new and improved harness-type securing system for personal equipment which provides in the apparatuses and methods of the prior art some of the advantages thereof, while simultaneously overcoming some of the disadvantages normally associated therewith.

Even still another object of the present invention is to provide a new and improved harness-type securing system for personal equipment for enabling users to carry and quickly access various items of personal equipment.

Lastly, it is an object of the present invention to provide a new and improved harness-type securing system for personal equipment adapted for use in association with personal equipment comprising a harness assembly comprising at least two front straps, at least two rear straps and a central strap coupler, each strap having an inboard end and an outboard end, each strap including adjustment means, the inboard ends of each straps being coupled to the center strap coupler, in an operative orientation a user positioning harness upon his torso; and at least two pouches, each pouch having at least one compartment and including securement means to firmly retain personal objects therein, each pouch being couplable to the harness to enable users to carry personal equipment in a suspended orientation from the harness.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 discloses an enlarged perspective view of the cellular telephone pouch of the apparatus.

FIG. 3A discloses an enlarged perspective view of the pouch connector.

FIG. 4 discloses an enlarged perspective view of the electronic organizer pouch of the apparatus.

FIG. 4A discloses an isolated perspective view of a pouch connector and its associated bolt and nut.

The same reference numerals refer to the same parts through the various Figures.

DESCRIPTION OF THE PREFERRED EMBODIMENT

Figure 1:
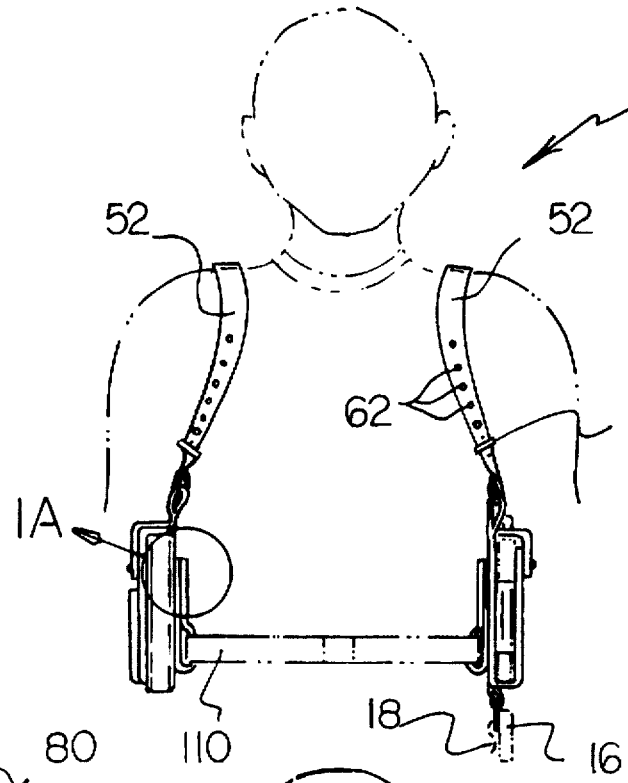
FIG. 1 is a perspective view of the preferred embodiment of the harness-type securing system for personal equipment constructed in accordance with the principles of the present invention.

With reference now to the drawings, and in particular, to FIG. 1 thereof, the preferred embodiment of the new and improved harness-type securing system for personal equipment embodying the principles and concepts of the present invention and generally designated by the reference number 10 will be described.

Specifically, it will be noted in the various Figures that the device relates to a harness-type securing system for personal equipment 10. In its broadest context, the device consists of a harness and a plurality of pouches. Such components are individually configured and correlated with respect to each other so as to attain the desired objective.

The harness-type securing system for personal equipment 10 enables users to carry business and recreational equipment on their torsos. This efficient configuration allows the user easy access to the equipment. The carry pouches are positioned adjacent to the hips of the user to minimize interference with normal activities. Since a carry bag is not required, potential misplacement of the equipment is minimized. The apparatus is available in a plethora of different materials to satisfy the aesthetic tastes of different users. A sport coat completely conceals the apparatus.

Various electronic devices are included with the apparatus. A cellular telephone 12 is formed in a generally rectangular configuration with an upper end including an antenna 14. A pager 16 is formed in a generally rectangular configuration with a rear clip 18. An electronic organizer 20 is formed in a planar, generally rectangular configuration. A calculator 22 includes a keypad. A note pad 24, a pen 31 and a plurality of business cards 26 are included with the apparatus. A camera 28 has a lens 30 and two associated film cylinders 32. A personal stereo 34 includes a rear clip 36 and headphones 38. A handgun 40 has a butt 42, a barrel 44 and a trigger guard 46 and associated magazine clip 48. Note FIGS. 1, 3 4A and 5–8.

Figure 2A:
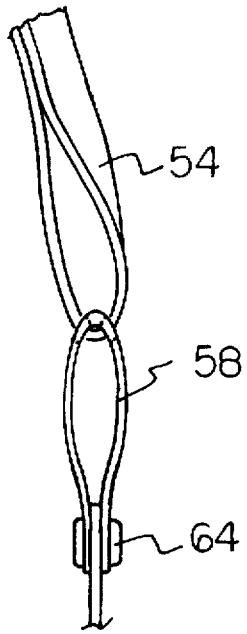
FIG. 2A discloses an enlarged perspective view of a pouch connector taken along section line 2A of FIG. 2.
Figure 2:
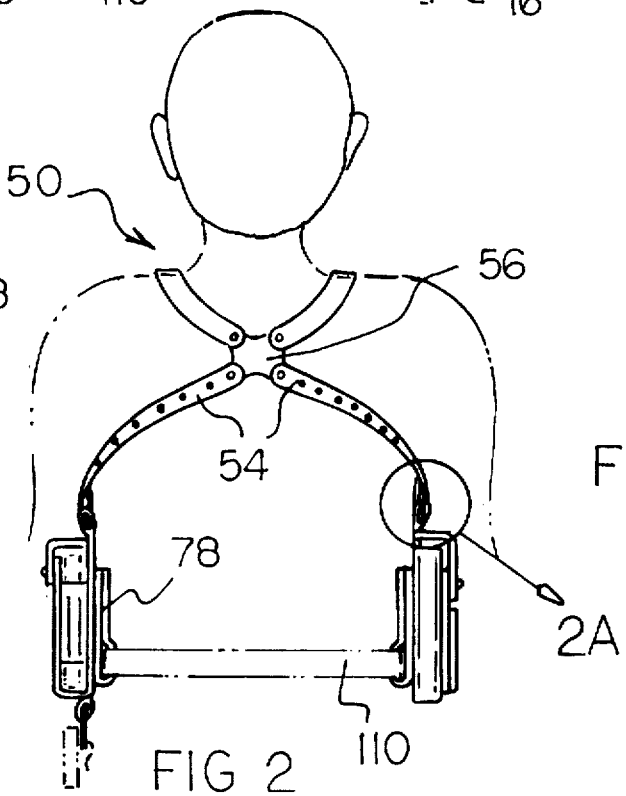
FIG. 2 discloses a rear perspective view of the apparatus illustrating the back portion of the apparatus.
Figure 5:
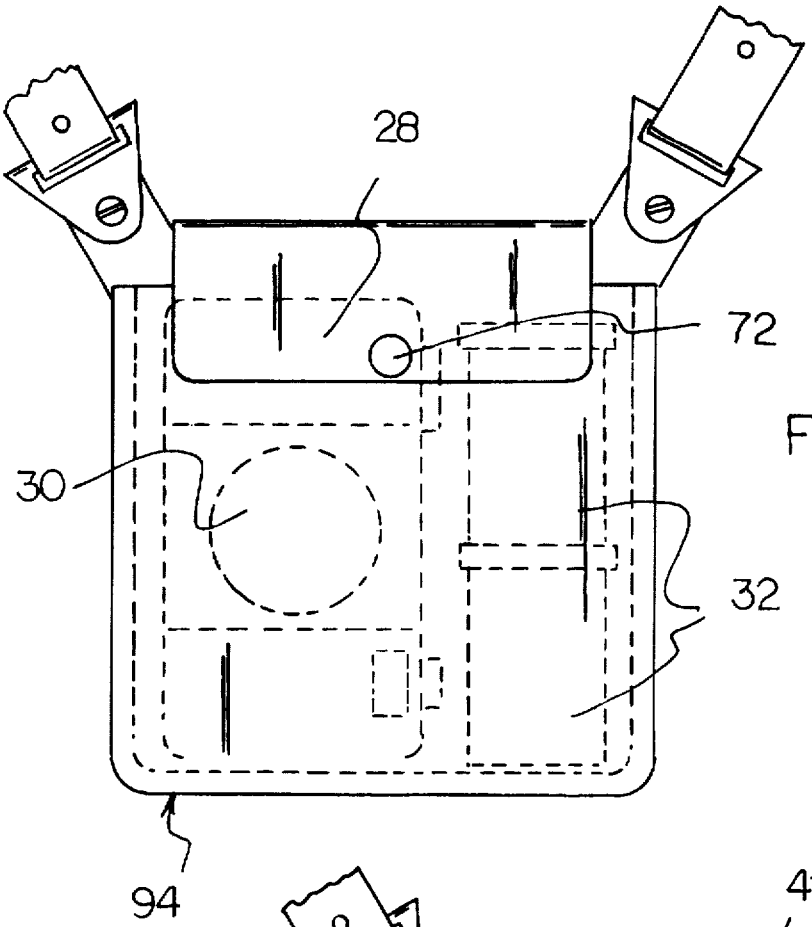
FIG. 5 discloses an enlarged perspective view of the camera pouch of the apparatus.
Figure 6:
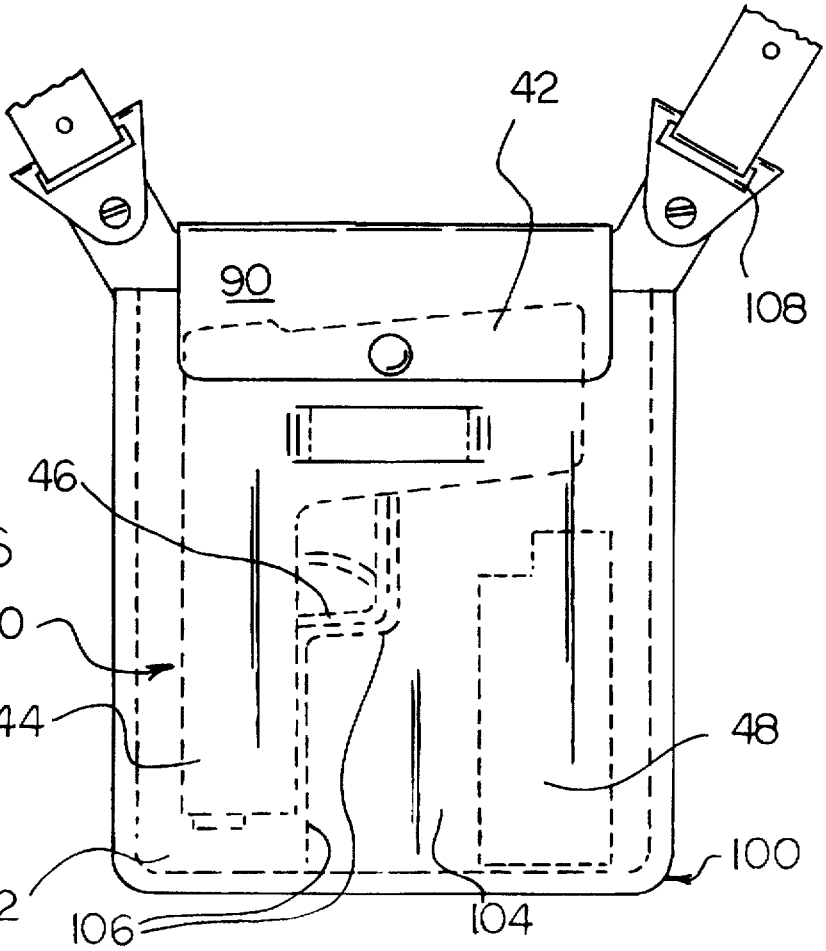
FIG. 6 discloses an enlarged perspective view of the handgun pouch of the apparatus.
Figure 7:
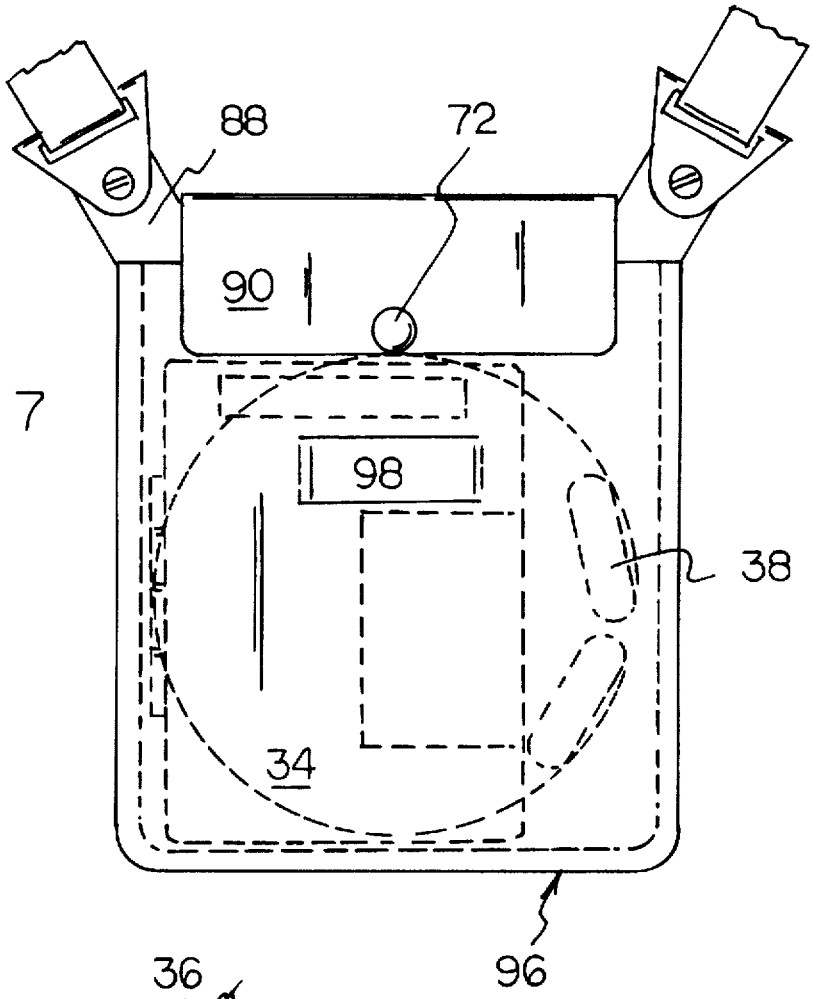
FIG. 7 discloses an enlarged perspective view of the personal stereo pouch of the apparatus.
Figure 8:
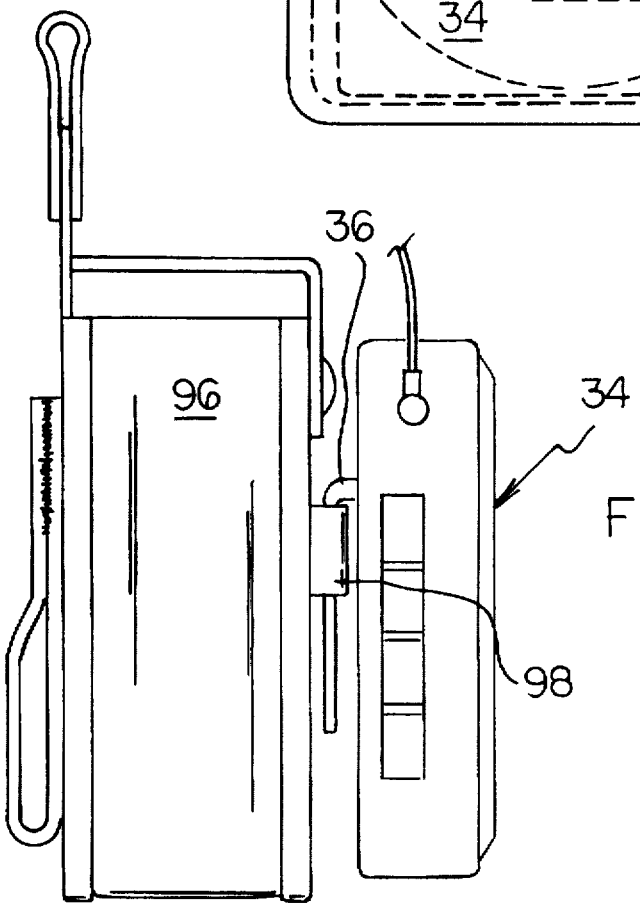
FIG. 8 discloses a side perspective view of a personal stereo affixed to the outer clip of the personal stereo pouch.

A harness assembly 50 comprises two front straps 52, two rear straps 54, a central strap coupler 56 and four pouch couplers 58. In the preferred embodiment each strap is fabricated of leather formed in an elongated planar rectangular configuration. In alternate embodiments of the apparatus the straps are fabricated of a plurality of different materials such as VINYL, alligator skin, synthetic materials and different shades of leather including brown, black and tan. Note FIGS. 1 and 2.

Figure 1A:
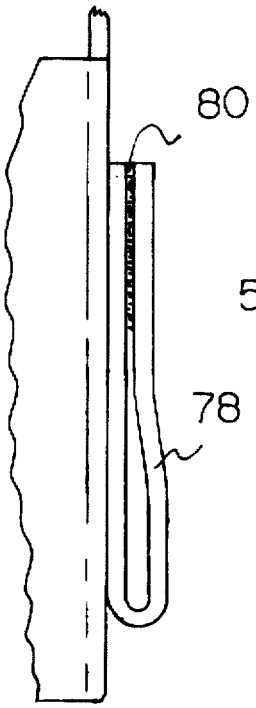
FIG. 1A discloses an enlarged front perspective view of the belt securing strip taken along section line 1A of FIG. 1.

Each strap has an inboard end, an outboard end and a center point. Each strap also includes a rectangular ring 60 positioned around it. Each front strap includes a plurality of spaced circular holes 62 positioned between the center point and the outboard end. Each rear strap includes a plurality of spaced circular holes 62 throughout its length. The central strap coupler is formed in a generally rectangular configuration with four corners which each include apertures. The inboard ends of each of the straps are coupled to the center strap coupler 56 by rivets 64. In an operative orientation, a user positions the harness upon his torso with the front straps extending over his shoulders and across his chest. The rear straps extend downwardly and outwardly along his back. Note FIGS. 1, 1A and 2.

Several different types of p ouches are included with the apparatus. This arrangement allows the user to select the pouches and related equipment he will need to perform a particular function. For example, during a normal business day the user would probably select the cellular telephone pouch and the business organizer pouch. During recreational hours the user may select the camera and personal stereo pouches. In the preferred embodiment each of the pouches are fabricated of leather. In alternate embodiments of the apparatus the pouches are fabricated of a plurality of different materials such as VINYL, alligator skin, synthetic materials and different shades of leather including brown, black and tan. Note FIGS. 3–8.

The cellular telephone pouch 66 is fabricated of leather and formed in a generally rectangular configuration with a front face, a rear face, an interior compartment, a lower loop 68 and two elastic side sections. The front face has an upper extent which includes a snap coupler. The rear face includes two upper horns which each have an aperture. A securing strip is coupled to the rear face between the upper horns. The securing strip 70 has an outboard end which includes a snap coupler 72. Note FIGS. 1–3.

A pager holder 74 is formed in a generally rectangular configuration and includes a rectangular shaped aperture 76. The pager 16 holder is coupled through the lower loop. A belt securing strap 78 has a free outboard end and an inboard end coupled to the rear face of the pouch. The belt securing strap has about twice the length of the pouch. The inboard and outboard ends each include pile type fasteners 80. In an operative orientation a user positions the cellular telephone within the pouch and secures it in place by coupling the securing strip to the front face. A user couples the pager to the pager holder by fastening the rear clip 18 of the pager through the aperture of the pager holder 76. Note FIGS. 1–3.

An electronic organizer pouch 82 is fabricated of leather and formed in a generally rectangular configuration with a front face, a rear face, an interior compartment and two side walls. The front face includes a large front pocket 84, a small front pocket 86, a pen slot 29 and an upper extent including a snap coupler. The rear face includes a rear pocket 25 and two upper horns 88 which each have an aperture. A securing flap 90 is coupled to the rear face between the upper horns. The securing flap has an outboard end including a snap coupler 72. Note FIG. 4.

A belt securing strap 78 has a free outboard end, a midpoint and an inboard end. The midpoint and the inboard end are coupled to the rear pocket 25 of the rear face. The belt securing strap has about twice the length of the pouch. The inboard and outboard ends each include pile type fasteners. In an operative orientation a user positions the electronic organizer 20 within the pouch and secures it in place by coupling the securing flap to the front face. The note pad 24 is positioned within the rear pocket. The calculator 22 is positioned within the large front pocket. The business cards 26 are positioned within the small front pocket and the pen 31 is positioned within the pen slot 29. Note FIGS. 1 and 4.

A camera pouch 94 is fabricated of leather and formed in a large generally rectangular configuration with a front face, a rear face, an interior compartment and two side walls. The side walls are sufficiently wide to permit placement of the camera 28 with a protruding lens 30 inside. The front face has upper extent which includes a snap coupler. The rear face includes two upper horns which each have an aperture. A securing flap 90 is coupled to the rear face between the upper horns. The securing flap has an outboard end which includes a snap coupler 72. A belt securing strap 78 has a free outboard end, a midpoint and an inboard end. The midpoint and the inboard end are coupled to the rear face. The belt securing strap has about twice the length of the pouch. The inboard and outboard ends each include pile type fasteners. In an operative orientation a user positions the camera and the film cylinders within the pouch and secures them in place by coupling the securing flap to the front face. Note FIG. 5.

A personal stereo pouch 96 is fabricated of leather and formed in a generally rectangular configuration with a front face, a rear face, an interior compartment and two side walls. The front face has an upper extent which includes a snap coupler and an attachment clip 98 positioned between its midpoint and upper extent. The rear face includes two upper horns 88 which each have an aperture. A securing flap 90 is coupled to the rear face between the upper horns. The securing flap has an outboard end which includes a snap coupler. A belt securing strap 78 has a free outboard end, a midpoint and an inboard end. The midpoint and the inboard end are coupled to the rear face. The belt securing strap has about twice the length of the pouch. The inboard and outboard ends each include pile type fasteners. In a first operative orientation a user positions the personal stereo 34 and headphones 38 within the pouch and secures them in place by coupling the securing flap to the front face. In a second operative orientation a user secures the rear clip 36 of the personal stereo to the attachment clip 98 on the front face of the pouch. Note FIGS. 7 and 8.

A handgun pouch 100 is fabricated of leather and formed in a generally rectangular configuration with a front face, a rear face, two side walls and an interior compartment. The interior compartment is divided into separate gun 102 and magazine 104 compartments by internal stitching. The internal stitching 106 is shaped to follow the contour of the butt 42, trigger guard 46 and barrel 44 of the handgun. This configuration allows the user to tightly position a handgun within the pouch thereby minimizing unwanted movement. Note FIG. 6.

The front face has an upper extent which includes a snap coupler and an attachment clip similar to that shown in connection with the front face of the personal stereo pouch positioned between its midpoint and upper extent. The attachment clip allows a user to attach an article to the handgun pouch. The rear face includes two upper horns which each have an aperture. A securing flap is coupled to the rear face between the upper horns. The securing flap has an outboard end which includes a snap coupler. A belt securing strap has a free outboard end, a midpoint and an inboard end. The midpoint and the inboard end are coupled to the rear face. The belt securing strap has about twice the length of the pouch. The inboard and outboard ends each include pile type fasteners. In an operative orientation a user positions the handgun within the handgun compartment with the barrel of the gun facing downward. The magazine clip is positioned within the magazine compartment. A user secures the handgun and magazine clip in place by coupling the securing flap to the front face. Note FIG. 6.

The four pouch connectors 58 are each formed in a generally diamond shaped configuration with two slits 108 separated by a central section 59. Each pouch connector has two ends which include apertures extending through them. The slits of a pouch connector are positioned around each of the four straps adjacent to its outboard end. The outboard end of each strap is folded upon itself and coupled in place by releasably couplable rivets 64 which are positioned through aligned holes of the strap. Two pouches are couplable to the harness at one time. A pouch is coupled to the harness by securing the horns of the pouch to the pouch connector of a front strap and the pouch connector of a rear strap with releasably couplable rivets. The straps are adjustable so that about one-third of the pouch is suspended below the user's belt 110 adjacent to the user's hip. The user then secures the belt securing strip around his belt to minimize movement of the apparatus. Note FIGS. 2A and 3A.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved harness-type securing system for personal equipment comprising, in combination:

a cellular telephone; a pager with a rear clip; an electronic organizer; a calculator; a note pad, business cards and a pen; a camera and two associated film cylinders; a personal stereo including a rear clip and headphones; a handgun having a butt, a barrel, a trigger guard and associated magazine clip;

a harness assembly comprising two front straps, two rear straps, a central strap coupler and a plurality of pouch connectors, each strap having an inboard end and an outboard end, each strap including a plurality of spaced circular holes positioned therethrough, the central strap coupler being formed in a planar configuration and including a plurality of apertures, the inboard ends of each of the straps being coupled to the center strap coupler by rivets, in an operative orientation a user positioning the harness assembly upon his torso with the front straps extending over his shoulders and across his chest, the rear straps extending downwardly and outwardly along his back;

a cellular telephone pouch, an electronic organizer pouch, a camera pouch, a handgun pouch and a personal stereo pouch, each pouch being formed in a generally rectangular configuration with a front face, a rear face, an interior compartment and two side walls, each front face having an upper extent including snap coupling means, each rear face including two upper horns and securing means couplable to the snap coupling means of the front face for securing an article within the pouch, each pouch including a belt securing strap having inboard and outboard ends including pile type fasteners, the inboard end being coupled to the rear face of the pouch;

the cellular telephone pouch including a lower loop, a pager holder being coupled through the lower loop and including an aperture, the two side walls of the cellular telephone pouch being formed of elastic materials and the securing means comprising a securing strip, in an operative orientation a user positioning the cellular telephone within the pouch and securing it in place; a user coupling the pager to the pager holder by fastening the rear clip of the pager through the aperture of the pager holder;

the front face of the electronic organizer pouch including a large front pocket, a small front pocket and a pen slot, the rear face including a rear pocket, the securing means comprising a securing flap, in an operative orientation a user positioning the electronic organizer within the pouch and securing it in place, the note pad being positioned within the rear pocket, the calculator being positioned within the large front pocket, the business cards being positioned within the small front pocket and the pen being positioned within the pen slot;

the side walls of the camera pouch being sufficiently wide to permit placement of the camera therein, the securing means comprising a securing flap, in an operative orientation a user positioning the camera and the film cylinders within the pouch;

the personal stereo pouch including an attachment clip affixed to its front face, the securing means comprising a securing flap, in a first operative orientation a user positioning the personal stereo and headphones within the pouch, in a second operative orientation a user securing the rear clip of the personal stereo to the attachment clip on the front face of the pouch;

the interior compartment of the handgun pouch being divided into separate gun and magazine compartments by internal stitching, the internal stitching being shaped to follow the contour of the butt, trigger guard and barrel of the handgun, the securing means comprising a securing flap, in an operative orientation a user positioning the handgun within the handgun compartment with the barrel of the gun facing downward, the magazine clip being positioned within the magazine compartment; and a pouch connector being positioned around each of the four straps adjacent its outboard end, the outboard end of each strap being folded upon itself and coupled in place by releasably couplable rivets, two pouches being couplable to the harness at one time, a pouch being coupled to the harness assembly by securing the horns of the pouch to the pouch connector of a front strap and the pouch connector of a rear strap with releasably couplable rivets, the straps being adjustable so that about one-third of the pouch is suspended below the user's belt adjacent to the user's hip, the user then securing the belt securing strap around his belt to minimize movement.

2. A new and improved harness-type securing system for personal equipment comprising, in combination:

a harness assembly comprising two front straps, two rear straps, a central strap coupler and a plurality of pouch connectors, each strap having an inboard end and an outboard end, each strap including coupling means, the central strap coupler being formed in a planar configuration and including coupling means, the inboard ends of each of the straps being coupled to the central strap coupler by said coupling means of said central strap coupler and each said strap, in an operative orientation a user positioning the harness assembly upon his torso with the front straps extending over his shoulders and across his chest, the rear straps extending downwardly and outwardly along his back;

a cellular telephone pouch, an electronic organizer pouch, a camera pouch, a handgun pouch and a personal stereo pouch, each pouch having a front face, a rear face, an interior compartment and two side walls, each front face having an upper extent including snap coupling means, each rear face including two upper horns and securing devices couplable to the snap coupling means of the front face for securing an article within the pouch, each pouch including a belt securing strap having inboard and outboard ends including coupling means securable to each other, the inboard end being coupled to the rear face of the pouch;

the cellular telephone pouch including a lower loop, a pager holder being coupled through the lower loop and including an aperture, in an operative orientation, a cellular telephone being positionable within the pouch and securing it in place and a pager having a rear clip being securable to the pager holder by fastening the rear clip of the pager through the aperture of the pager holder;

the front face of the electronic organizer pouch including a large front pocket, a small front pocket and a pen slot, the rear face including a rear pocket, in an operative orientation, an electronic organizer being positionable within the pouch and securing it in place, a note pad being positionable within the rear pocket, a calculator being positionable within the large front pocket, business cards being positionable within the small front pocket and a pen being positionable within the pen slot;

the side walls of the camera pouch being sufficiently wide to permit placement of a camera therein, in an operative orientation, the camera and the film cylinders being positionable within the pouch;

the personal stereo pouch including an attachment clip affixed to its front face, in a first operative orientation, a personal stereo and headphones being positionable within the pouch, in a second operative orientation, rear clip of a personal stereo being securable to the attachment clip on the front face of the pouch;

the interior compartment of the handgun pouch being divided into separate gun and magazine compartments by internal stitching, the internal stitching being shaped to follow the contour of the butt, trigger guard and barrel of a handgun, in an operative orientation, a the handgun being positionable within the handgun compartment with the barrel of the gun facing downward, and a magazine clip being positionable within the magazine compartment; and a pouch connector being positioned around each of the four straps adjacent its outboard end, the outboard end of each strap being folded upon itself and coupled in place, two pouches being couplable to the harness assembly at one time, a pouch being coupled to the harness assembly by securing the horns of the pouch to the pouch connector of a front strap and the pouch connector of a rear strap with releasably couplable rivets, the straps being adjustable, a user then securing the belt securing strap around a belt worn by the user to minimize movement.

3. The harness-type securing system as set forth in claim 2 wherein the harness and pouches are fabricated of black leather.

4. The harness-type securing system as set forth in claim 2 wherein the harness and pouches are fabricated of brown leather.

5. The harness-type securing system as set forth in claim 2 wherein the harness and pouches are fabricated of vinyl.

6. The harness-type securing system as set forth in claim 2 wherein the harness and pouches are fabricated of alligator skin.

7. The harness-type securing system as set forth in claim 2 wherein the harness and pouches are fabricated of synthetic materials.

8. A harness type securing system adapted for use in association with personal equipment comprising:

a harness assembly comprising at least two front straps, at least two rear straps and a central strap coupler, each strap having an inboard end and an outboard end, each strap including adjustment means, the inboard ends of each strap being coupled to the central strap coupler, in an operative orientation, a user positioning the harness assembly upon the user's torso, the adjustment means of each strap comprising a plurality of spaced holes and cooperatively couplable rivets; and at least two pouches, each pouch having at least one compartment and including securement means to firmly retain personal objects therein, the securement means of each pouch including a releasably couplable snap, each pouch being couplable to the harness assembly to enable users to carry personal equipment in a suspended orientation from the harness assembly wherein two pouches being couplable to the harness at one time, the harness assembly including two front straps and two rear straps, in an operative orientation, a user positioning the harness assembly upon the user's torso with the front straps extending over the user's shoulder's and across the user's chest, the rear straps extending downwardly and outwardly along the user's back, wherein one of the pouches is a cellular telephone pouch formed in a generally rectangular configuration with a front face, a rear face, an interior compartment, a lower loop and two elastic side sections, the front face having an upper extent including a snap coupler, the rear face including two upper horns each having an aperture, a securing strip being coupled to the rear face between the upper horns, the securing strip having an outboard end including a snap coupler, a pager holder formed in a generally rectangular configuration and including a rectangular shaped aperture, the pager holder being coupled through the lower loop, a belt securing strap having a free outboard end and an inboard end coupled to the rear face of the pouch, the belt securing strap having about twice the length of the pouch, the inboard and outboard ends each including pile type fasteners, in an operative orientation a user positioning a cellular telephone within the pouch and securing it in place by coupling the securing strap to the front face, a pager being couplable to the pager holder by fastening the rear clip of the pager through the aperture of the pager holder.

9. The harness-type securing system as set forth in claim 8 wherein one of the pouches is an electronic organizer pouch formed in a generally rectangular configuration with a front face, a rear face, an interior compartment and two side walls, the front face including a larger front pocket, a small front pocket and an upper extent including a snap coupler, the rear face including a rear pocket and two upper horns each having an aperture, a securing flap being coupled to the rear face between the upper horns, the securing flap having an outboard end including a snap coupler, a belt securing strap having a free outboard end, a midpoint and an inboard end, the midpoint and the inboard end being coupled to the rear pocket of the rear face, the belt securing strap having about twice the length of the pouch, the inboard and outboard ends each including pile type fasteners, in an operative orientation a user positioning an electronic organizer within the pouch and securing it in place by coupling the securing flap to the front face, a note pad being positionable within the rear pocket, a calculator being positionable within the large front pocket, business cards being positionable within the small front pocket.

10. The harness-type securing system as set forth in claim 9 wherein one of the pouches is a camera pouch formed in a large generally rectangular configuration with a front face, a rear face, an interior compartment and two side walls, the side walls being sufficiently wide to permit placement of a camera with a protruding lens therein, the front face having upper extent including a snap coupler, the rear face including two upper horns each having an aperture, a securing flap being coupled to the rear face between the upper horns, the securing flap having an outboard end including a snap coupler, a belt securing strap having a free outboard end, a midpoint and an inboard end, the midpoint and the inboard end being coupled to the rear face, the belt securing strap having about twice the length of the pouch, the inboard and outboard ends each including pile type fasteners, in an operative orientation a user positioning a camera and film cylinders within the pouch and securing them in place by coupling the securing flap to the front face.

11. The harness-type securing system as set forth in claim 10 wherein one of the pouches is a personal stereo pouch formed in a generally rectangular configuration with a front face, a rear face, an interior compartment and two side walls, the front face having an upper extent including a snap coupler and an attachment clip affixed thereto between its midpoint and upper extent, the rear face including two upper horns each having an aperture, a securing flap being coupled to the rear face between the upper horns, the securing flap having an outboard end including a snap coupler, a belt securing strap having a free outboard end, a midpoint and an inboard end, the midpoint and the inboard end being coupled to the rear face, the belt securing strap having about twice the length of the pouch, the inboard and outboard ends each including pile type fasteners, in a first operative orientation a user positioning a personal stereo and headphones within the pouch and securing them in place by coupling the securing flap to the front face, in a second operative orientation a user securing a rear clip of a personal stereo to the attachment clip on the front face of the pouch.

12. The harness-type securing system as set forth in claim 11 wherein one of the pouches is a handgun pouch formed in a generally rectangular configuration with a front face, a rear face, two side walls and an interior compartment divided into separate gun and magazine compartments by internal stitching, the internal stitching being shaped to follow the contour of a butt, trigger guard and barrel of a handgun, the front face having an upper extent including a snap coupler and an attachment clip affixed thereto between its midpoint and upper extent, the rear face including two upper horns each having an aperture, a securing flap being coupled to the rear face between the upper horns, the securing flap having an outboard end including a snap coupler, a belt securing strap having a free outboard end, a midpoint and an inboard end, the midpoint and the inboard end being coupled to the rear face, the belt securing strap having about twice the length of the pouch, the inboard and outboard ends each including pile type fasteners, in an operative orientation a user positioning a handgun within the handgun compartment with the barrel of the gun facing downward, a magazine clip being positioned within the magazine compartment, a user securing the handgun and magazine clip in place by coupling the securing flap to the front face.

13. The harness-type securing system as set forth in claim 12 and further including:

a cellular telephone formed in a generally rectangular configuration with an upper end including an antenna; a pager formed in a generally rectangular configuration with a rear clip; an electronic organizer formed in a planar, generally rectangular configuration; a calculator including a keypad; a note pad and a plurality of business cards; a camera having a lens and two associated film cylinders; a personal stereo including a rear clip and headphones; a handgun having a butt, a barrel and a trigger guard and associated magazine clip.

* * * * *